United States Patent [19]

Peek et al.

[11] 4,096,367

[45] Jun. 20, 1978

[54] GAS INSULATED CIRCUIT BREAKER INCORPORATING COMPLETE MODULAR INTERRUPTER STRUCTURE AND OPERATING MECHANISM

[75] Inventors: Henry L. Peek, Brandon; Maurice J. Taylor, Florence; John J. Abdou; Amrut R. Patel, both of Brandon, all of Miss.

[73] Assignee: Allis-Chalmers Corporation, Milwaukee, Wis.

[21] Appl. No.: 635,161

[22] Filed: Nov. 24, 1975

[51] Int. Cl.[2] ..... H01H 33/82

[52] U.S. Cl. ..... 200/148 B; 200/148 R; 200/148 F

[58] Field of Search ..... 200/148 R, 148 B, 148 E, 200/148 F, 145

[56] References Cited

U.S. PATENT DOCUMENTS

| | | | |
|---|---|---|---|
| 3,057,983 | 10/1962 | Yeckley et al. | 200/145 |
| 3,350,528 | 10/1967 | McKeough | 200/148 B |
| 3,596,028 | 7/1971 | Kane | 200/148 F |
| 3,930,134 | 12/1975 | Rostron et al. | 200/148 F |

*Primary Examiner*—Robert K. Schaefer
*Assistant Examiner*—Michael K. Mutter
*Attorney, Agent, or Firm*—Robert C. Jones

[57] ABSTRACT

A gas insulated circuit breaker arrangement incorporating a modular interrupter structure and having a centrally disposed single opening pull-rod and stopping means for both ends of the pull-rod stroke for controlling the movement of all of the masses of the moving parts. The acceleration spring always opposes the closing force thereby insuring that the pull-rod is in tension. Compression structure is provided to resist the tension force applied by the pull-rod and also to stabilize the interrupter structure.

3 Claims, 9 Drawing Figures

GAS INSULATED CIRCUIT BREAKER INCORPORATING COMPLETE MODULAR INTERRUPTER STRUCTURE AND OPERATING MECHANISM

BACKGROUND OF THE INVENTION

This invention relates generally to gas insulated circuit breakers and more particularly to multi-interrupter arrangements with associated operating mechanisms and high pressure gas storage and support means all within a single gas tight enclosure.

In prior art circuit breakers as exemplified in U.S. Pat. No. 3,057,983, there is disclosed an arrangement of a plurality of serially related interrupters. Therein the high pressure reservoir and a blast valve mechanism are disposed adjacent one end of the arc extinguishing assembly which bridges the space between spaced terminal bushings. Support of the interrupter assembly is obtained from the terminal bushings. The general operation of the above-identified interrupter is such that during the opening operation a single blast valve opens to allow the gas from the high pressure chamber to blast through a plurality of blast tubes and into the interrupting units. In other words, the interrupter furthest from the high pressure chamber is expected to receive its share of the gas blast as soon as the interrupter which is closest to the high pressure source receives its share. The pull-rods or operating rods are of ladder shape construction, arranged on each side of the interrupter structure. This arrangement necessitates cross arms which adds to the mass that the acceleration spring must move. In U.S. Pat. Nos. 3,852,549 and 3,891,862, a pull-rod arrangement which is external to the enclosure is shown which is, of course, even more remote from the mass which the acceleration spring must move. With these disclosed arrangements elaborate shock absorbing devices must be supplied to reduce the shock load on the structure and prevent damage to the equipment.

Also in the above-mentioned patents, the serially related interrupter is not of modular construction and there is nothing disclosed therein which operates on the interrupters to counteract the effect of tensioning forces that are applied to the interrupter through the pull-rods in their closing and opening operation.

The concept provides truly modular design with each interrupter being a complete, independent operating unit not dependent on any other unit. Thus, it is not necessary to reengineer and retest the design every time the number of interrupters per phase is changed as has been necessary with prior art structures.

With known gas insulated circuit breakers, redesign and testing has been necessary with a change in the number of interrupters per phase to assure that the opening time is sufficiently fast to achieve: (a) the short interrupting time demanded and (b) that the moving parts are stopped at the ends of the opening stroke without excessive rebound and stressing of the moving parts. It is also noted that with known gas insulated circuit breakers the pull-rods and linkages from the operating mechanism to each of the interrupters must be designed to take both compressive loads and tensile loads. To withstand the compressive loads without buckling, the long pull-rods are designed several times larger in cross-section of pull-rods that need only stand tensile loads. This increases the weight of the pull-rods which, in turn, requires much greater forces to accelerate them and also to stop them. These additional forces also impart greater bearing loads and greater loads on the supports. Greater friction is also encountered at each bearing. Thus, the operator mechanism must be designed larger and stronger to accommodate the larger masses, forces and friction that has previously been mentioned. It is also known that with prior art gas-insulated circuit breakers the moving contacts inside the pole unit will experience oscillations at the ends of the strokes with the acceleration and the stopping means being located outside of the interrupter because of the elasticity of the linkages in between.

The present invention provides advantages not obtainable in the past. One such advantage obtains by providing individual opening accelerating and individual opening and closing stopping means within each interrupter. In this manner, the pull-rods between interrupters are under tension in both directions of movement and thus require minimum cross-section and mass. Bearing size, acceleration forces and operating stresses are maintained at a minimum. The size of the operating mechanism is minimized and contacts can be opened and closed in minimum time. With the present concept, the interrupters are truly modular wherein the same interrupter structure without change is capable of being used in many circuit voltage ratings. Proving the interrupter ratings of a wide range of circuit breakers can be achieved with a minimum of expensive short circuit interrupting tests. Included in the concept are stabilizing means in the form of compression members both between the enclosure end and the adjacent interrupter and between interrupters. With this concept, volume manufacturing minimum cost in material stocking and inventory.

A general object of this invention is to provide interrupters for gas-insulated circuit breakers which can be used either one per phase or in a greater number per phase as required by the magnitude of the phase voltage.

Another object of this invention is to provide a pull-rod arrangement which locates the pull-rod in close proximity to the mass that it will operate.

Still another object of this invention is to provide a modular interrupter structure for a gas insulated circuit breaker incorporating accelerating and stopping means sufficient for each interrupter within the circuit breaker module.

A further object of this invention is to provide internal support for the interrupters within the enclosure that counteracts the force of the tension on the pull-rods and also assists the interrupter support is carrying the interrupter structure.

Yet another object of the present invention is to provide motion transmitting mechanism which is in tension at all times so that the mass of the structure may be reduced and relatively lightweight materials may be utilized.

A still further object of the present invention is to provide improved mechanism for controlling the velocity of movement of the contacts which will also serve as a shock absorbing means.

SUMMARY OF THE INVENTION

In accordance with the present invention, there is provided a gas-insulated circuit breaker for high voltage service. A single gas-tight enclosure accommodates a plurality of serially related interrupters each of which is supplied with high pressure insulating and arc extinguishing insulating gas from an associated supply source also serving as a support. Pull-rods associated with each interrupter are coupled together to operate in unison. Reduction in the weight of the movable means to be accelerated has been accomplished by locating the pull-rod and the stopping means as close to the center of the interrupter as possible. This reduces the forces, stresses and cost of the structure and associated linkages. Regardless of the fact that the pull-rods of the several interrupters are connected together so as to operate in unison, each interrupter has its own opening accelerating spring and also stopping means for both ends of the stroke of its associated pull-rod. The arrangement is such that the individual accelerating springs and stops are sufficient for controlling the movement of all of the mass of moving parts of the individual interruper unit.

DESCRIPTION OF THE DRAWINGS

FIGS. 1A and 1B taken together is a view partly in elevation and partly in vertical section through a gas-insulated circuit breaker having several serially connected interrupters and in which the present invention is incorporated;

DESCRIPTION OF THE INVENTION

Figure 1A:
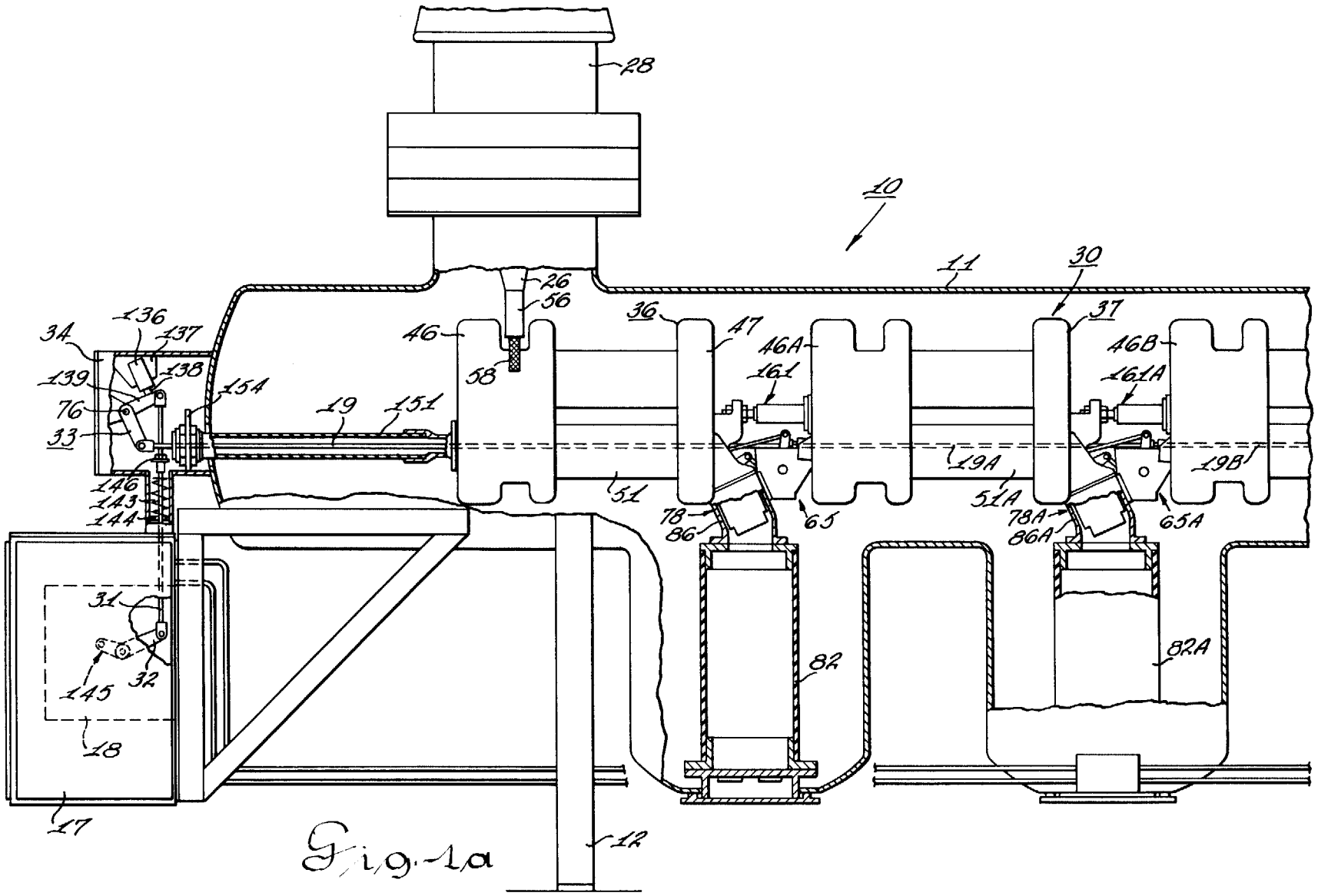

Referring now to the drawings and more particularly to FIGS. 1A and 1B, the reference numer 10 generally designates a single phase gas-insulated circuit breaker. It will be understood for controlling three phases of a transmission system, a circuit breaker 10 will be utilized for each phase of th system.

Generally, the circuit breaker 10 includes a grounded tank or enclosure 11 which is adapted to be gas tight. The enclosure 11 is mounted on supports 12 and 14 which are welded or otherwise secured to longitudinally extending steel side beams (not shown).

Adjacent the left end of the enclosure 11 is an operating mechanism housing 17 in which, among other equipment, is an operating mechanism 18 of a suitable type. The operating mechanism 18 is operable upon a signal to effect longitudinal movement of an interconnected pull-rod 19 in an interrupter closing operation. As shown, the pull-rod 19 is disposed within the enclosure 11 and extends parallel to the longitudinal axis of the enclosure. Terminal bushings 26 and 27 extend downwardly into the interior of the enclosure 11 through cylindrical supports 28 and 29, respectively.

The interior ends of the terminal bushings 26 and 27 are electrically connected to each end of arc extinguishing assemblage 30 but do not support the assemblage 30.

The operating mechanism 18 within the housing 17 is operatively connnected to the pull-rod 19 by means of a vertical rod 31, the lower end of which is pivotally connected to an operating lever 32 of the mechanism 18. The upper or opposite end of the vertical rod 31 extends into an end box 34 and is pivotally connected to one end of pivotal bell crank 33. The other end of the bell crank 33 is pivotally connected to the end of the pull-rod 19. The pull-rod 19 has a connection with the several axially aligned pull-rods 19A, 19B and 19C associated with the interrupters 37, 38 and 39, respectively, and are arranged to effect the simultaneous movement of the contacts of the plurality of interrupters 36, 37 38 and 39 in an opening and closing movement. The separation between the several movable contacts such as the contact 41 associated with the interrupter 36 and the relatively stationary contacts such as the contact 42 draws a plurality of serially related arcs in an arcing area 43.

Each of the interrupter units 36, 37 38 and 39 generally comprises a pair of shield members, such as a forward shield casting 46 and a rearwardly located shield casting 47, between which is secured an insulating cylindrical contact housing 51.

At the right end of the interrupter unit 39, an auxiliary shield 52 is provided which is electrically connected and secured to the interrupter 39 by means of an electrically conductive bracket 53.

The interior ends 56 and 57 of the bushings 26 and 27 are electrically connected to the electrically conductive shields 46 and to the auxiliary electrically conductive shield 52 by flexible metallic conductors 58 and 59, respectively. The bridging metallic flexible conductors 58 and 59 do not serve as a support means for the interrupter assembly and, thus, no stresses are placed on the bushings 26 and 27.

Each of the interrupter units 36, 37, 38 and 39 are substantially similar and a description of the interrupter unit 36 will also apply to the other units 37, 38 and 39. Generally, the interrupter unit 36 comprises a relatively stationary contact structure 42, FIG. 2, that is cooperable with the relatively movable tubular contact structure 41.

Figures 2, 8:
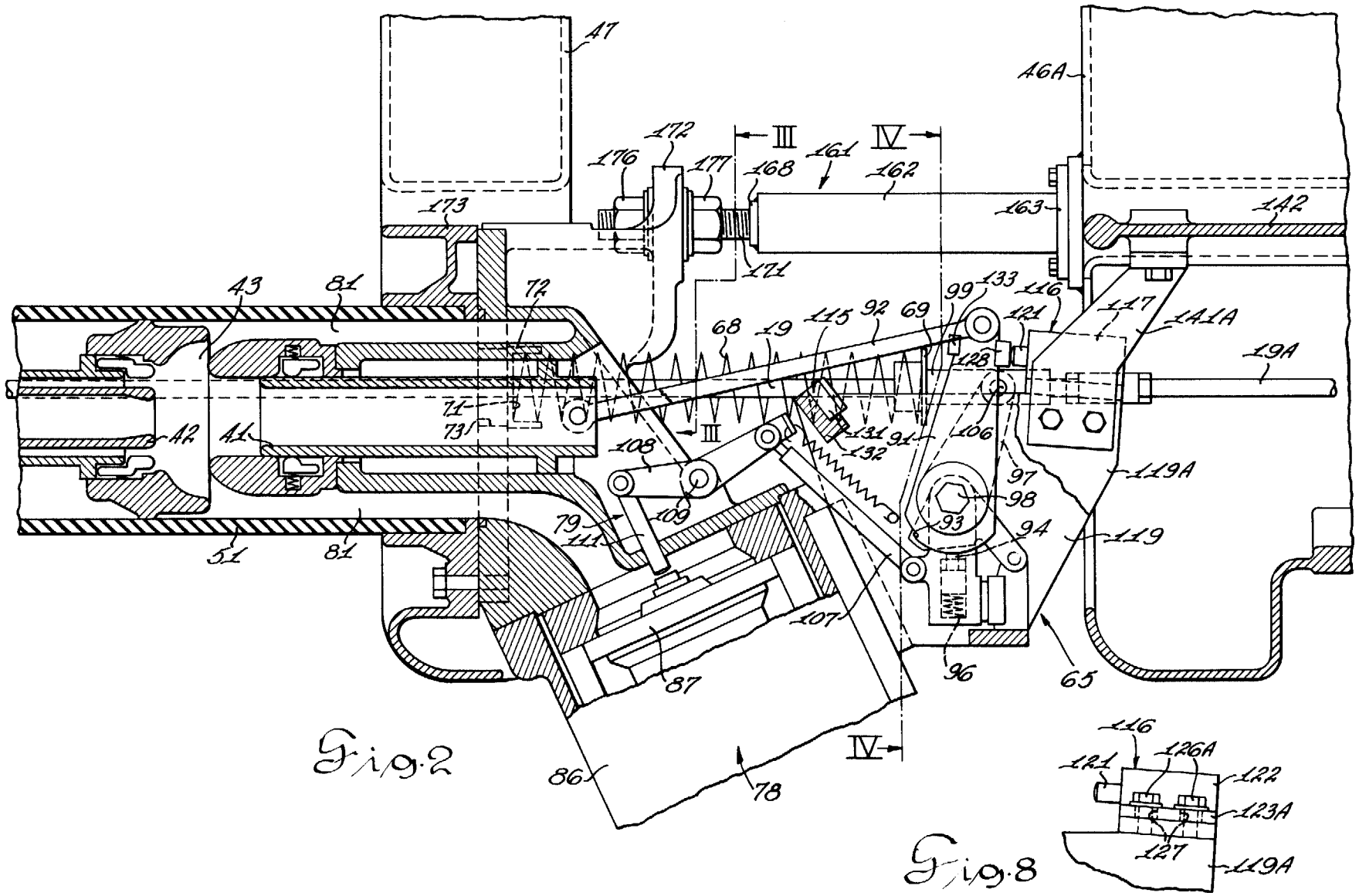
FIG. 2 is a detailed fragmentary view of the contacts of a typical interrupter showing the contact actuating linkage, pull-rod, accelerating springs, stops and compression member.

The plurality of movable contacts 41 of the several serially related interrupters are actuated between an open and a closed position by linkage means 65, 65A, 65B and 65C operatively connected to the substantially centrally disposed longitudinally extending pull-rods 19, 19A, 19B and 19C. All of the pull-rods 19, 19A, 19B and 19C are releasably connected together so as to move as a single unit to effect the simultaneous operation of the associated movable contacts. As shown, the pull-rod 19 is operatively connected to the bell crank 33 associated with the operating mechanism 18. An acceleration spring 68 is mounted around the pull-rod 19 at the right-hand end thereof. The acceleration spring 68 is a compression spring having one end abutting an adjustable spring retainer 69. The opposite end of th acceleration spring 68, as shown in FIG. 2, abuts a bottom surface 71 of a recess that is formed in a retainer 72 disposed in a suitable opening 73 formed in the shield 47 through which the pull-rod 19 extends. The arrangement provides for the location of the pull-rod 19 parallel to and as close as possible to axis of the contacts 41-42. This makes possible a reduction in the size of the linkage and overall reduces the mass which the accelerating spring 68 and the operation mechanism 18 must move. Thus, operation of the operating mechanism 18 in a first mode will cause the bell crank 33 to pivot about a pin 76 in a clockwise direction putting the pull-rods under tension and will effect the movement of the pull-rods 19, 19A, 19B and 19C in a first direction to the left, as viewed in FIG. 1A-1B, to close the contacts of the interrupters and also charge the acceleration springs 68. The force exerted by the acceleration springs 68 always opposes the closing force insuring that the pull-rods are always in tension. When the operating mechanism 18 is tripped, the stored energy in the several acceleration springs 68 will be released to move the pull-rods in a second direction or to the right under tension, as viewed in FIGS. 1A–1B, to effect the movement of the several contacts to open position thereby establishing a plurality of serially related arcs.

Extinction of the arcs drawn between the contacts of the several interrupters in the arcing area at the axial end of the movable contacts 41 is aided by means of a blast of high pressure gas to the arcing area 43. The blast of high pressure gas is released by operation of a blast valve 78. The opening operation of the blast valve in synchronism with the opening of the contacts is accomplished by the associated linkage 79. The linkage 79 is connected to the contact linkage 65 and operates in unison therewith upon movement of the pull-rod 19 in its second direction to open the contacts. As the contacts part, the several blast valves are opened so that a blast of gas at a relatively high pressure is directed to the arcing area 43 via passages 81 to effect extinction of the arc drawn between the several movable contacts.

Associated with each of the interrupters 36, 37, 38 and 39 is a high pressure gas storage tank or chamber 82. The storage tanks each contain a volume of gas for its associated interrupter. Thus, each interrupter is an independent unit operating in synchronism with all the other interrupter units. The failure of one supply does not affect the remaining interrupters. In addition, the storage tanks 82 operate to support the interrupters within the enclosure 11.

As shown in FIG. 2, the blast valve 78 is operatively disposed within a housing portion 86. Within the housing 86, a displaceable valve member 87 is resiliently urged in a normal sealing position to close the passage 81 until such time as it is displaced to allow a blast of gas at a relatively high pressure to be delivered to the arcing area. Operation of the movable contact 41 and the valve member 87 is effected by movement of a crank 91.

In FIG. 2, the crank 91 is shown in a position after it has operated to move the contact 41 to open position and to release the blast valve member 87 for return to its normal closed position. When the crank 91 is pivoted in the counterclockwise direction, a link 92 forces the contact 41 leftwardly into a closed position. AT the same time, a cam notch 93 formed on the lower end of the crank 91 is moved into a position to the right of a displaceable tongue 94 in a latch body 96. Thus, with the crank 91 positioned leftwardly the movable contact 41 will have been moved to a closed position and the latch cam notch 93 will be connected to the latch body 96 in readiness for an opening operation of the contact 41 and of blast valve member 87.

Movement of the crank 91 for operating the contact 41 to a closed position, or for the simultaneous operation of the contact 41 and the blast valve 87 to open positions, is effected by means of the pull-rod 19. The pull-rod 19 at its right end, as viewed in FIG. 2, has a pivotal connection with the upper end of an operating crank 97. The operating crank 97 is secured to a horizontal shaft 98 on which the crank 91 and latch body 96 are mounted. The latch body 96 is mounted on the shaft 98 to rotate relative to the shaft. On the other hand, the crank 91 is secured to the shaft 98 so as to be driven by the rotation of the shaft. Thus, pivotal movement of the operating crank 97 in a counterclockwise direction will effect rotation of the shaft 98 which, in turn, causes the pivotal movement of the crank 91 in a counterclockwise direction moving the contact 41 to a closed position and coupling the notch 93 with the latch tongue 94. As the pull-rod 19 under tension moves leftwardly to effect the closing of the contact 41, acceleration spring 68 mounted about the pull-rod 19 is compressed or charged for a subsequent operation in a contact opening movement.

The operating crank 97 is connected to the enlarged end 99 of the pull-rod 19 by means of a pin 106. Thus, axial movement of the pull-rod 19 will effect arcuate movement of the operating crank 97. This arcuate movement of the crank 97, in turn, effects rotation of the shaft 98 thereby moving the lever arm 91 to effect movement of the contact 41. As previously mentioned, movement of the lever 91 from its contact closed position in a clockwise direction to the position that it occupies in FIG. 2, which is the contact open position, will also effect movement of the latch body 96 in a clockwise direction. This movement moves a connecting link 107 axially to effect counterclockwise movement of an arm 108 about a pin 109. An actuating pin 111 secured to the opposite end of the arm 108 is then moved axially into engagement with the blast valve 87 to displace the valve. As a result, a blast of gas under relatively high pressure is delivered to the arcing area 43 via the passage 81.

As previously mentioned, the pull-rods 19, 19A, 19B and 19C associated with the interrupters 36, 37, 38 and 39, respectively, are connected together in axial alignment to move as a single pull-rod assembly. The movement of the pull-rods 19, 19A, 19B and 19C in a contact closing movement is leftwardly, as viewed in FIGS. 1A-1B, which is accomplished by the operating mechanism 18. Thus, in a closing movement the pull-rod assembly is under tension. In a contact opening movement, the pull-rods 19, 19A, 19B and 19C are moved rightwardly under the influence of their individual acceleration springs 68, 68A, 68B and 68C. Thus, in an opening movement, the pull-rods are also under tension.

As previously mentioned, stopping means 115 and 116 for both directions of travel of each of the pull-rods 19, 19A, 19B and 19C are provided. The stops 115 and 116, shown in FIG. 2, exemplifies the stops associated with all of the interrupters. The opening stop means 116 comprises a shock absorber 117 which has limited axial travel to prevent the abrupt stopping of the crank 91 in a contact opening operation. The stop or shock absorber 117 is carried by a pair of spaced apart brackets 119 and 119A, FIG. 4, in position wherein the axial movable plunger 121 is in the path of travel of the crank 91. For this purpose, the housing 122 of the stop 116 is welded to a pair of spaced apart bars 123 and 123A which, in turn, are bolted to a transverse plate 124. The plate 124 is welded to the upper surfaces of the brackets 119-119A. Securing means such as bolts 126-126A extend through longitudinally extending slots 127 into threaded engagement with the plate 124 to adjustably secure the stop 116 in operative position. A hardened strike plate 128, FIG. 2, is welded or otherwise secured to the crank 91 in position to engage the plunger 121 of the stop. Thus, by selective position of the stop 116, the distance of travel of the movable contact 41 in an opening movement is controlled.

The closing stop 115 comprises a resilient pad 131 bonded to transverse plate 132 that is welded to the brackets 119-119A. A strike plate 133 is welded to the crank 91 in position to engage with stop 115 when the crank is moved in a counterclockwise direction. Thus the stops 115 and 116 positively control the travel of the crank 91 in both directions of contact movement. With the contact 41 in open position, the stop 116 may be adapted to preload the acceleration spring 68 to a predetermined desired amount. In this manner, the preload acceleration spring 68 will apply a predetermined tension force to the pull-rod 19 to move the rod rightwardly in a contact opening movement. Since the interrupter units 36, 37, 38 and 39 each have an associate pull-rod 19, 19A, 19B and 19C and, of course, acceleration springs 68, each acceleration spring thereby operates to effect movement of its individual pull-rod and associated pull-rod linkages, contact, blast valve, capacitor and resistor switches. Thus, each acceleration spring need only be of a size to take care of its associated mass and will be of considerable smaller size than that of a single acceleration spring for the entire pull-rod assemblage.

To insure that the operation of the acceleration spring 68 associated with the interrupter unit 36 is not hampered by the mass of the operator arm 32, the operator vertical rod 31 and the crank 33, a separate acceleration spring 143 to move these masses is provided. As shown in FIG. 1A, the spring 143 is engaged around the rod 31 with the lower end thereof abutting a fixed plate 144. With the interrupter contact 41 in open position, the upper end of the spring 143 is free and clear of an adjustable abutment 146 carried by the rod 31. In a contact closing movement, the operator 18 will cause the rod 31 to be moved vertically downwardly to pivot the bell crank 33 in a clockwise direction. Clockwise movement of the bell crank pulls the pull-rod 19 leftwardly to close the contact 41. As the rod 31 moves downwardly, the adjustable abutment engages with the upper end of the spring 143 to compress the spring. In a contact opening operation, the linkage 145, associated with the operator 18, collapses releasing the vertical rod 31 for movement. As a result, the stored energy in the compressed spring 143 moves the rod 31 upwardly and effects the pivotal movement of the bell crank. Thus, the upward movement of the rod 31 and the pivotal movement of the bell crank is not imposed as a load on the acceleration spring 68. With the movement of the rod 31 and bell crank 33 established, the velocity imparted thereto by the spring 143 need not be continued and the effect of the spring 143 is removed. This is accomplished by making the spring 143 a predetermined length so that the energy stored in the spring 143 will be only sufficient to initiate and continue the movement of the rod 31 and bell crank a predetermined distance. After this point has been reached, the spring 143 has no effect and the masses will no longer be accelerated as maximum desired velocity has been obtained.

To insure that the pull-rod 19 is not subjected to compressive force loading by the operator 18, an adjustable over-travel shock absorber 136 is provided in the end box 34. The shock absorber 136 is similar to the shock absorber stop 116, and is supported for axial adjustment within the end box 34 on a bracket 137. As shown in FIG. 2, the shock absorber 136 faces downwardly so that its plunger 138 is located in the path of travel of the arm 139 of the bell crank 33. The arrangement is such that in a contact opening operation the acceleration spring 68 operates to move the rod 19 rightwardly under tension. Simultaneously, the spring 143 also effects counterclockwise movement of the bell crank 33 and upward movement of the vertical rod 31 and arm 32. These members obtain a velocity and tend to keep moving after the contact 41 is open and the crank 91 is in engagement with the stop 116. Thus, the pull-rod 19, after it has stopped moving rightwardly, would be subject to a compressive force from the moving bell crank 33, rod 31 and arm 32 and would buckle and also damage the linkages and contacts. However, the shock absorber stop 136 operates to absorb this force by stopping the bell crank 33 at the time that the pull-rod 19 engages the stop 116.

Figure 4:
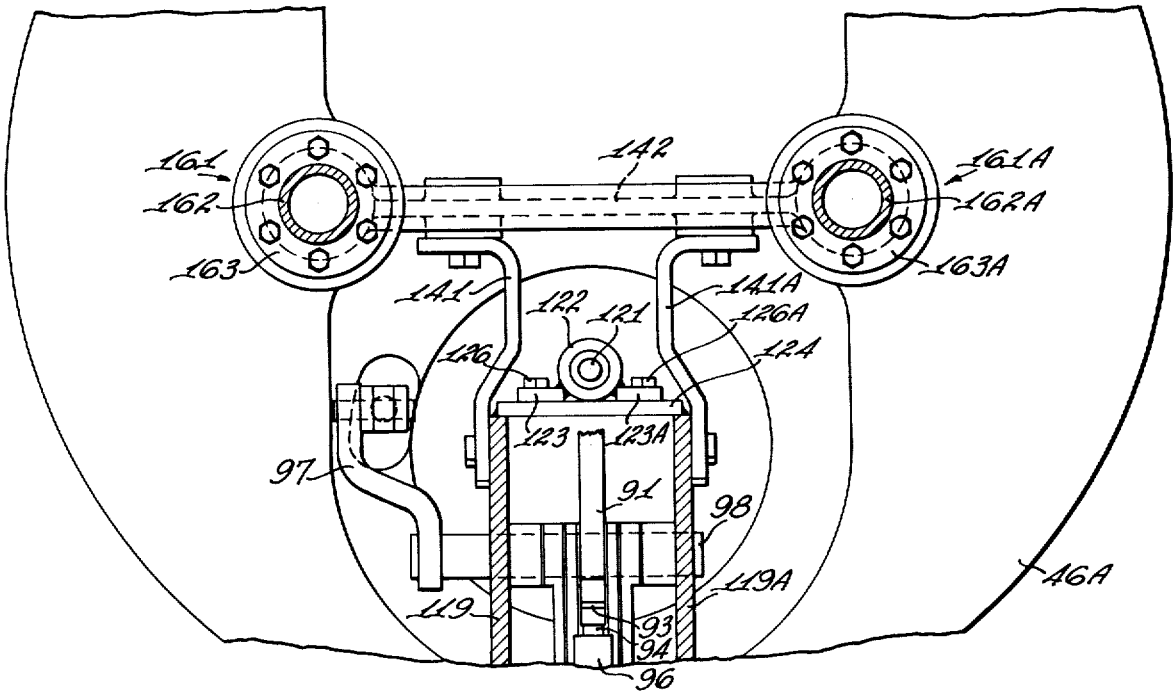
FIG. 4 is an enlarged fragmentary view in elevation, taken in a plane represented by the line IV—IV in FIG. 2, showing the left-hand end shield of the adjacent interrupter and the arrangement for accommodating the pull-rod and stabilizer.

As previously mentioned, the opening stop 116 is carried on the transverse plate 124 secured to the brackets 119-119A, FIGS. 2 and 4. The brackets 119-119A are arranged in spaced apart relationship and are secured to the blast valve housing 86 extending upwardly therefrom. To stabilize the free upper ends of the brackets 119-119A there is provided tie brackets 141-141A that are screw fastened to the associate bracket 119-119A. The upper ends of the tie brackets are bolted to a transverse horizontal web member 142 integrally formed with the shield 46A. This arrangement provides for stability and support of the left-hand end of interrupter 37.

Figures 5, 6, 7, 13:
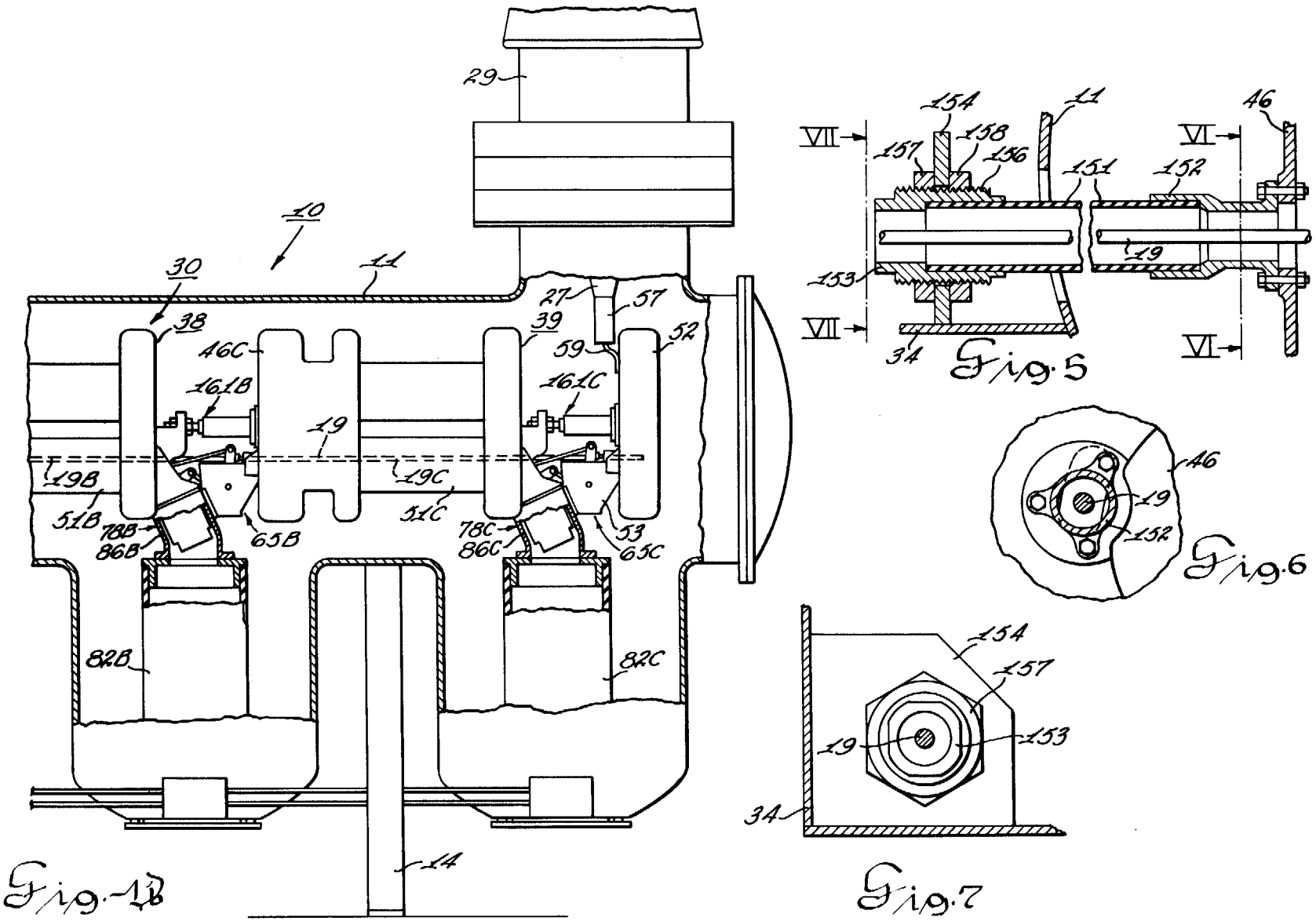
FIG. 5 is an enlarged fragmentary view of the compression member between the left end of the first interrupter and the end of the enclosure.
FIG. 6 is an enlarged fragmentary view of the attaching means coupling the compression member to the interrupter and taken in a plane represented by the line VI—IV in FIG. 5.
FIG. 7 is an enlarged fragmentary view of the adjusting means on the left end of the compression member taken in a plane represented by the line VII—VII in FIG. 5; and, FIG. 8 is an enlarged detailed view of the shock absorber shown in FIG. 2.

As shown in FIGS. 1A and 1B, and as previously mentioned, the interrupters 36, 37, 38 and 39 are supported in cantilever fashion by the associated high pressure storage tanks 82, 82A, 82B and 82C. Thus, the force movements from the weight of the interrupters and also the forces experienced in contact opening and closing operation stresses the internal structure and, if not relieved, would require that the high pressure storage tanks be extremely large to the point of not being feasible because of size and cost. To counteract the movement forces and also the longitudinally applied forces experienced in the contact opening and closing operations, an arrangement of compression members are provided. To this purpose, a compression tube 151 is provided between the end of the interrupter 36 and the end box 34. The compression tube 151 surrounds the pull-rod 19 and has its right end engaged in a fitting 152. As shown in FIG. 5, the fitting 152 is secured to a mounting surface formed on the outer surface of the shield 46. The opposite or left end of the tube 151 extends through the end wall of the enclosure 11 and is engaged in a coupling 153. The coupling 153 extends through a suitable opening provided in a vertical plate member 154 of the end box 34. For the purpose of preloading the tube 151, the exterior of the coupling is threaded as at 156 and receives a pair of nut members 157 and 158. By tightening the nut 158 on the coupling 153, the tube 151 can be loaded to a desired amount.

Thereafter, the nut 157 will be tightened to lock the tube in its preload state. Since the axis of the tube 151 coincides with the axis of the pull-rod 19, no unbalanced forces are applied to the end of the interrupter 36 and the tube acts as a relieving support member to counteract the force movements acting on the interrupter. Also, longitudinal acting forces from contact opening and closing operation are counteracted by the compression tube 151 acting between the structural plate 154 and the interrupter 36. Thus, not only are the opening and closing forces acting on the interrupter counteracted, but the end of the interrupter is given support to counteract the movements due to the cantilever arrangement.

Figure 3:
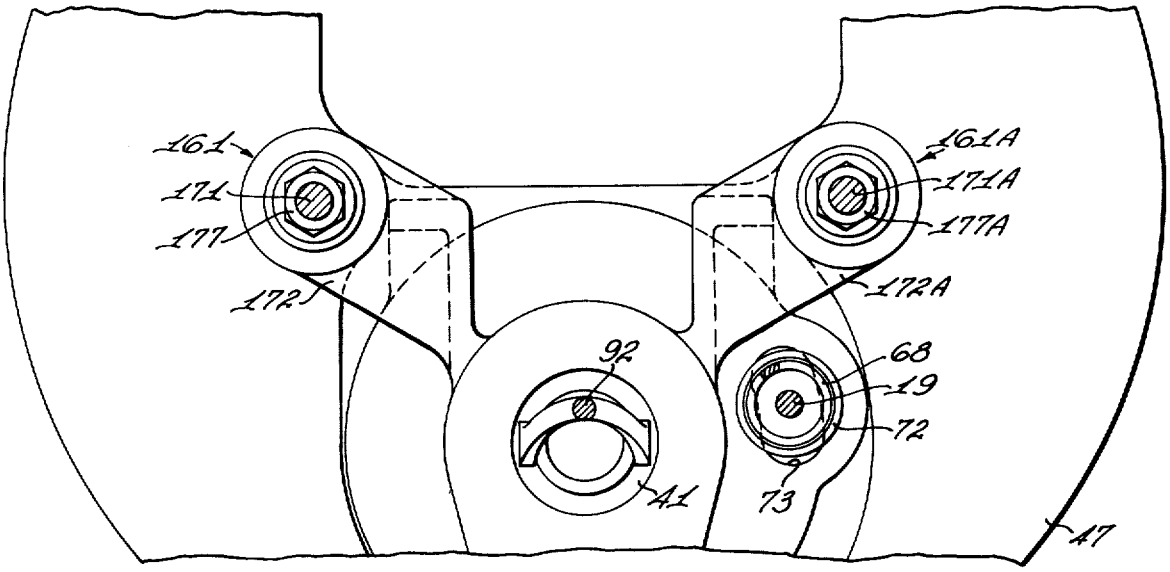
FIG. 3 is an enlarged fragmentary view in elevation, taken in a plane represented by the line III—III in FIG. 2, showing the right end shield of an interrupter with the linkage for operating the contacts and the pull-rod extending therethrough close to the moving mass and the center of the interrupter.

Between the interrupters 36 and 37, 37 and 38, and 38 and 39, a slightly different arrangement of compression members are provided. The compression members between interrupters are identical, and the description given for the members 161 and 161A will apply to the compression members between the other interrupters. As shown in FIGS. 1A, 3 and 4, the compression member 161 includes a tube portion 162 having an end captured in a collar 163. The collar 163 is screw fastened on a suitable pad formed on the shield 46A. The opposite end of the tube 162 is provided with a sleeve 168 which is securely fixed within the tube so as to be held against rotation and axial movement. The sleeve 168 is formed with a threaded bore that receives a threaded rod 171. The free end of the threaded rod extends through a suitable opening provided in a bracket 172, which is screw fastened on a suitable mounting surface formed on a transverse circular web portion 173 formed within the shield 47. As best seen in FIG. 2, the transverse web 173 of shield 47 serves to support the contact insulator housing or tube 51. A nut 177 threaded on the end of the rod 171 is tightened to preload the rod 171 and tube 162 and a nut 176 operates as a lock nut. With this arrangement, the forces on the interrupters are counteracted and the interrupter 37 is given additional support to counteract movement force due to the cantilever construction. It is to be noted that two compression members such as the members 161 and 161A are provided between interrupters. This is done because of the central location of the operating linkage and acceleration spring arrangement which makes it impossible to encompass the pull-rods between interrupters. Thus, to avoid an unbalance of forces, a pair of compression members are provided spaced equidistance from a vertical center line.

The embodiments of the invention in which an exclusive property or privilege is claimed are defined as follows:

1. In a gas insulated circuit breaker;

a gas tight enclosure having insulating gas therein at a relatively low pressure;

a pair of spaced apart circular corona shield members supported within said enclosure;

an elongated cylindrical housing of an insulating material secured to and between said shield members, said shield having its ends surrounded by said circular corona shields;

current interrupting means supported within said cylindrical housing;

a source of insulating gas at a relatively high pressure;

gas blast means associated with said current interrupting means and operable when actuated to direct a blast of insulating gas at a relatively high pressure from said source to said current interrupting means;

a single actuating pull-rod means extending through said corona shield members and said elongated cylindrical housing in close adjacency to said interrupting means, said actuating means being connected to operate said current interrupting means in a current interrupting operation and said gas blast means in synchronism; and, operating means connected to move said actuating means for operating said current interrupting means and said gas blast means in synchronism.

2. A gas insulated circuit breaker according to claim 1 wherein said current interrupting means includes at least a pair of contacts movable relative to each other in a current interrupting operation;

accelerating means operatively connected to move said pull-rod in a first direction to operate said circuit interrupting means and said gas blast means; and, said pull-rod extends parallel to said contact housing and through both of said shields wherein the first end of said pull-rod is connected to said operating means and the second end of said pull-rod receives said acceleration means and is also operatively connected to effect movement of said current interrupting means.

3. A gas insulated circuit breaker according to claim 2 wherein said circuit breaker includes a plurality of said current interrupting means having individual pull-rods and said pull-rods of each of said interrupting means are connected together in axial alignment, each of said interrupting means operating as an independent unit in synchronism with each other.

* * * * *